US006182302B1

(12) United States Patent
Marti et al.

(10) Patent No.: US 6,182,302 B1
(45) Date of Patent: Feb. 6, 2001

(54) FLUSH-MOUNTED FLUSH TANK

(75) Inventors: Silvio Marti, Rapperswil; Mario Von Ballmoos, Jona, both of (CH)

(73) Assignee: Geberit Technik AG, Jona (CH)

( * ) Notice: Under 35 U.S.C. 154(b), the term of this patent shall be extended for 0 days.

(21) Appl. No.: 09/141,612

(22) Filed: Aug. 28, 1998

(30) Foreign Application Priority Data

Sep. 24, 1997 (CH) ..... 2252/97

(51) Int. Cl.[7] ..... E03D 1/00
(52) U.S. Cl. ..... 4/353
(58) Field of Search ..... 4/353, 405, 410–414

(56) References Cited

U.S. PATENT DOCUMENTS 977,937 * 12/1910 Crane ..... 4/410
2,543,438 * 2/1951 Cochran ..... 4/411
5,210,883 * 5/1993 Weber et al. ..... 4/353 X

FOREIGN PATENT DOCUMENTS 31 39 834 A1 8/1982 (DE) .
0 544 616 B1 1/1998 (EP) .
471261 * 9/1937 (GB) ..... 4/411

* cited by examiner

*Primary Examiner*—Charles E. Phillips

(57) ABSTRACT

The flush-mounted flush tank has a tank body with a bottom wall, side walls with a front wall and a cover wall as well as an inspection opening. The front wall and the cover wall each have an inspection opening, which can be arranged optionally for actuation from the top or for actuation from the front at the time of mounting. The inspection opening not in use is covered with a closing plate. Only one tank body is needed for the two usual types of actuation, which substantially simplifies stock keeping and mounting.

7 Claims, 6 Drawing Sheets

FLUSH-MOUNTED FLUSH TANK

FIELD OF THE INVENTION

The present invention pertains to a flush-mounted flush tank, with a tank body, which has a bottom wall, side walls with a front wall and a cover wall, as well as an inspection opening.

BACKGROUND OF THE INVENTION

Flush-mounted flush tanks have been known for a long time and are described in, e.g., EP-A-0 544 616 and DE-A-31 39 834. Both the manufacture and the mounting of such flush-mounted flush tanks are comparatively complicated.

SUMMARY AND OBJECTS OF THE INVENTION

The basic object of the present invention is to provide a flush-mounted flush tank of the type mentioned that can be manufactured and mounted in a simpler manner and less expensively and is nevertheless reliable in operation.

This object is accomplished in a flush-mounted flush tank of this type by the front wall and the cover wall each having an inspection opening, which can be arranged optionally for actuation from the top or for actuation from the front. The flush-mounted flush tank according to the present invention has the essential advantage that only a single tank body needs to be manufactured for the two usual types of actuation. It is no longer necessary to manufacture two different flush tanks for actuation from the top and for actuation from the front. Thus, a single production line is sufficient for the manufacture of the two types of flush-mounted flush tanks. Since only one tank body is used, mounting is also more uniform and consequently simpler. As a consequence of the more universal use of the flush-mounted flush tank, stock keeping is also simplified. The flush-mounted flush tank according to the present invention may be pre-fitted already in the factory for actuation from the top or from the bottom. The upper inspection opening is closed in one case and the front inspection opening in the other case. The mounting will be especially simplified if a building protection frame is fastened to the tank body already in the factory according to a variant of the present invention. However, the flush-mounted flush tank according to the present invention can also be used such that one inspection opening or the other is attached only at the site of the installation corresponding to the intended actuation. Consequently, shipping of the wrong type of flush tank cannot happen.

Mounting is further simplified if the two inspection openings are designed as congruent openings. The means for the installation and the mounting of the actuating means is now the same for both types of actuation. For example, the same building protection frame may be used for actuation from the front and for actuation from the top.

The number of necessary parts can be further reduced if, according to a variant of the present invention, the building protection frame has at least one detachable cover, which can also be used to close the inspection opening not needed at the same time. The cover can thus be used as a closing plate. The building protection frame preferably has two such detachable covers. One of these two covers is used at the time of mounting as a closing plate to close one of the inspection openings. The other cover remains on the building protection frame until after building the wall and thus it prevents foreign bodies from penetrating into the flush tank during the building of the wall. Thus, not only does the flush-mounted flush tank according to the present invention substantially facilitate the manufacture and the mounting, but it also makes it possible to substantially reduce the number of different individual parts and consequently to simplify stock keeping.

According to a variant of the present invention, the actuating means is designed such that it can be used for both actuation from the front and actuation from the top. Thus, the same actuating means can be used for both types of actuation. A lever is preferably mounted for this purpose on a bearing block, wherein an axis of rotation of the lever is located on the bisectrix of the angle between the front and upper edges. According to a preferred embodiment of the lever, the latter has two fastening points in an angular arrangement. One of these fastening points is used for a horizontally directed push bar for actuation from the front, and the other fastening point for the vertically directed push bar for actuation from the top. The actuation can thus be performed with a prior-art cover plate. If a building protection frame and a closing plate form one unit according to a variant of the present invention, mounting can be further simplified and the number of individual parts can be further reduced. The building protection frame and the closing plate are arranged such that the building protection frame is placed on one inspection opening and the other inspection opening is closed with the closing plate at the same time. Provisions are preferably also made in this case for the same unit to be able to be used for both types of actuation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
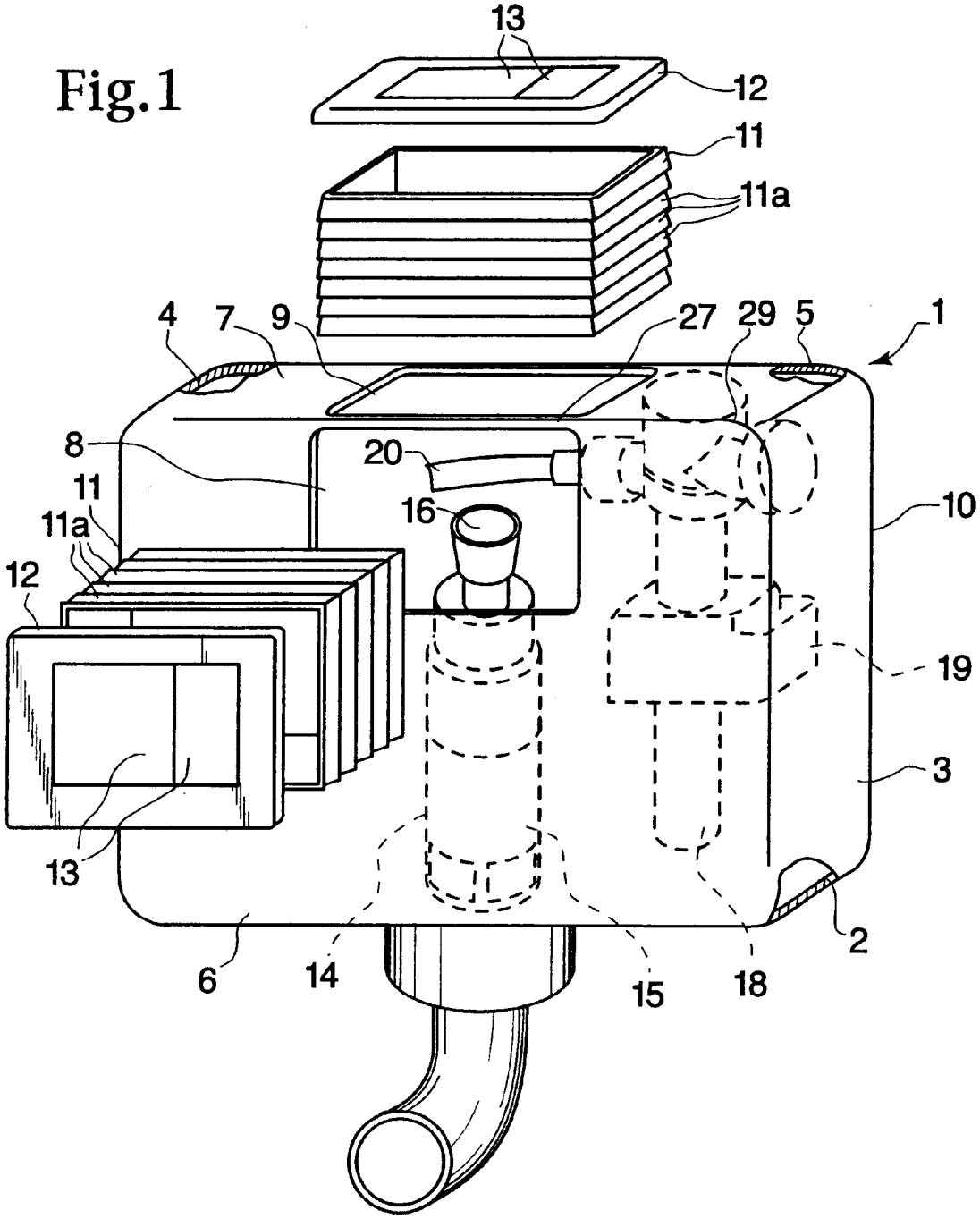
FIG. 1 schematically shows a three-dimensional representation of the flush-mounted flush tank according to the present invention, wherein individual parts are pulled apart for reasons of graphic representation, FIG. 2 schematically shows a section through part of the flush-mounted flush tank according to the present invention.
Figure 2:
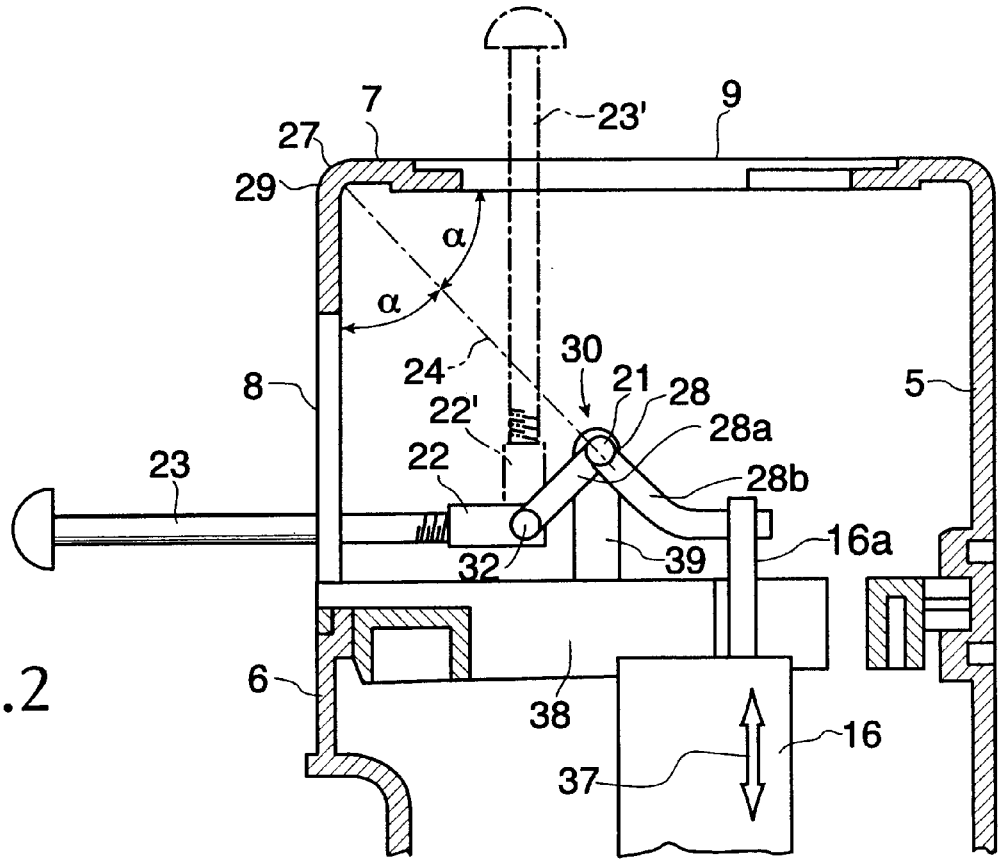

The flush tank 1 shown in FIG. 1 has a tank body 10, which is manufactured, e.g., by blow molding from a plastic. To fill the tank body 10 with flushing water, an inlet fitting 18 is accommodated in same. This fitting has, in the usual manner, a float 19, with which the filling process is interrupted during the refilling of the flush tank 1. The inlet fitting 18 is connected via a water pipe 20 to a supply line, not shown here. In addition, a drain fitting 14 with a housing 15 as well as with a valve tube 16 is located in the tank body 10. The drain fitting 14 is fastened in the bottom wall 2 of the tank body 10 and is used to trigger a flushing. To do so, the valve tube 16 is raised with the actuating means 30 shown in FIG. 2. With the drain fitting 14 open, the flushing water flows through a discharge pipe and into a toilet bowl or a urinal, not shown here. The fittings 14 and 18 are prior-art fittings and therefore they are not explained in greater detail here.

Besides the bottom wall 2, the tank body 10 has a cover wall 7 as well as side walls 3, 4, 5 and 6. The wall 6 forms the front wall and has a rectangular inspection opening 8. The cover wall 7 also has an inspection opening 9, which is preferably congruent with the inspection opening 8. The inspection openings 8 and 9 are consequently preferably of the same design. As can be seen, the openings 8 and 9 are separated from one another by a comparatively narrow web 27. This web 27 forms the front and upper edge 29 of the tank body 10 in some areas. According to FIG. 2, the actuating means 30, which has a frame-like mounting plate 38 with an upwardly extending bearing block 39, is located behind these inspection openings 8 and 9. A two-armed lever 28 is mounted at the bearing block 39. One arm 28*b* is connected to a strap 16*a* of the valve tube 16. The other lever arm 28*a* is connected to a push bar 23 via a hinge 32 and a threaded sleeve 22. The fulcrum point 21 of the lever 28 is preferably located, according to FIG. 2, on a bisectrix through the inner angle of the edge having a rectangular cross section. The drain fitting 14 may be actuated through the inspection opening 8 or through the inspection opening 9. If actuation through the inspection opening 8 and consequently from the front is intended, a push bar 23 is mounted in the horizontal arrangement, as is indicated by solid lines in FIG. 2. If the push bar 23 is moved to the right in FIG. 2, the two-armed lever 28 is pivoted counterclockwise around the axis of rotation 21 and the valve body 16 is thus lifted in one of the directions of the double arrow 37. For actuation from the top, the push bar 23 is arranged vertically, as is indicated by broken lines in FIG. 2. The threaded sleeve 22 is now pivoted upward around the hinge 32. However, the two push bars 23 and 23' are otherwise identical. For triggering flushing from the top, the push bar 23 is moved downward. The two-armed lever 28 is now pivoted, as was explained above, and the outlet fitting 14 is opened to trigger a flushing. The arrangement of the fulcrum point 21 on the bisectrix 24 offers the advantage of a simple lever movement, which is essentially the same for both actuations. The movement of the push bar 23 is performed with a cover plate 12, which has one or two buttons (13) and is mounted on the outside of the wall in the known manner. Interruption of the flushing is also possible, in which case the push bar 23 or 23' is moved forward or upward. However, another type of actuation, e.g., pneumatic actuation, is also possible.

Figure 3:
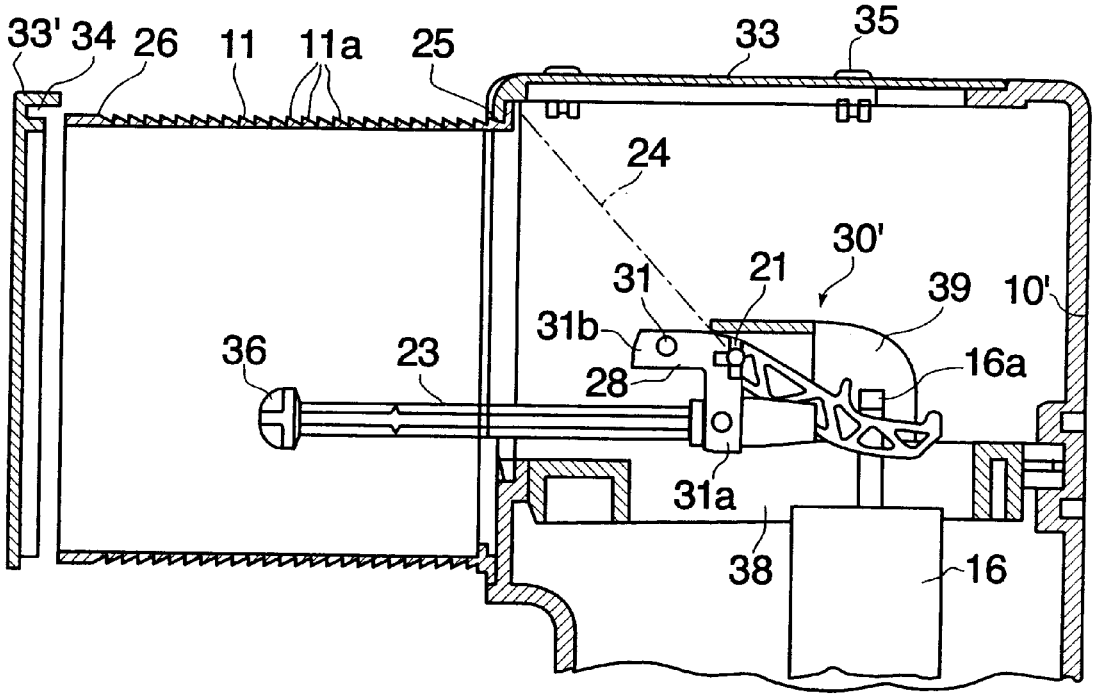
FIG. 3 shows a section through part of the flush-mounted flush tank according to the present invention, in which actuation from the front is provided.

If actuation from the front, i.e., through the inspection opening 8, is provided, the other inspection opening 9 is closed with a closing plate 33 according to FIG. 3. This is done, e.g., by means of four fastening elements 35, which pass through corresponding openings in the plate 33 and in the wall 7 and are preferably held by locking means. If actuation from the top is provided, the inspection opening 8 is closed with the plate 33 according to FIG. 4. For mounting the flush tank 1, a building protection frame 11 is placed on the inspection opening 8 or 9 that has not been closed, and fastened. This fastening is performed with an edge 25, which is made in one piece with the building protection frame 11 and engages a groove 34 of the mounted plate 33. In the embodiment of the tank body 10' shown in FIGS. 3 and 4, the web 27 shown in FIG. 1 is omitted. The two inspection openings 8 and 9 are thus connected to one another at the edge 29 here. The free end of the building protection frame 11 is connected to a cover 33', which has the same design as the plate 33. The cover 33' prevents foreign bodies from entering the flush tank 1 through the building protection frame 11 during the building of the wall. After the wall has been built, the cover 33' and the plate 33 are removed from the building protection frame 11. To fasten the cover 33' to the building protection frame 11, the latter has an edge 26, which is designed corresponding to the groove 34. The two edges 25 and 26 are preferably designed such that the plate 33 can be optionally placed on the edge 26 or 25. Before mounting the building protection frame 11, a plate 33 and a cover 33' are preferably placed on same. The plate is then used during mounting to close the inspection opening 8 or 9. The cover 33' remains on the building protection frame 11 until the wall-building operations have been concluded. As was mentioned above, the plate 33 and the cover 33' are of an exactly identical design. Thus, they differ in their functions only.

The building protection frame 11 comprises a plurality of circular strips 11*a*, which make possible the adaptation of the depth of the building, protection frame to the wall thickness in the known manner. Refer to the applicant's EP-A-0 544 616 in this connection. After the removal of the cover 33, the cover plate 12 is mounted, as it is also disclosed, e.g., in EP-A-0 544 616. In the case of actuation from the front according to FIG. 3, the cover plate 12 is now arranged on the right in front of the building protection frame 11, and the horizontally arranged push bar 23 is moved forward and backward with the buttons 13.

Figure 4:
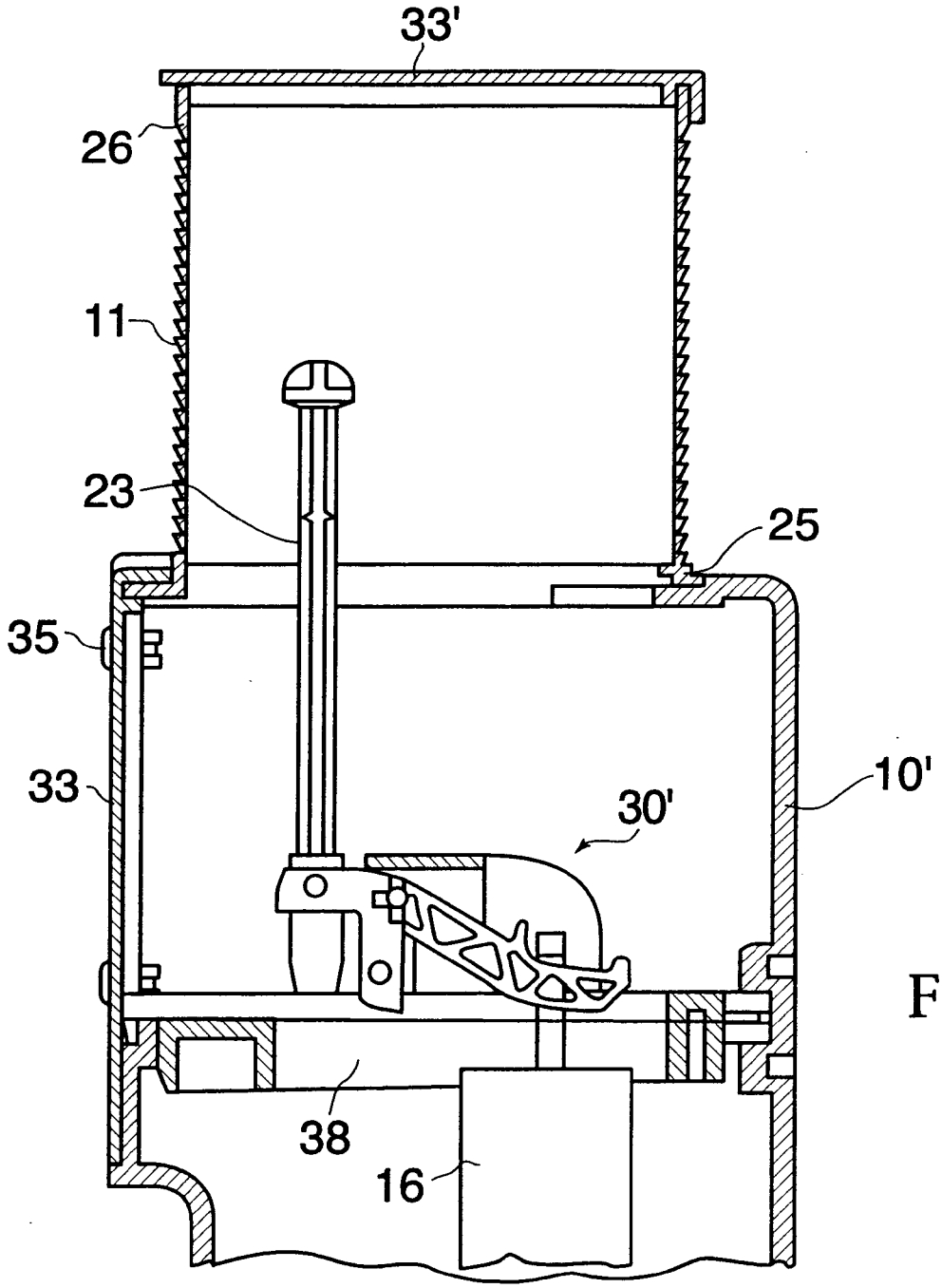
FIG. 4 shows a section according to FIG. 3, but with actuation from the top, FIG. 5 schematically shows a section through a variant of the flush-mounted flush tank according to the present invention, where actuation from the top is provided.

The actuating means 30' shown in FIGS. 3 and 4 differs from the actuating means 30 by the design of the lever 28'. This lever has an angular part 31, which makes possible an articulated connection of the push bar to a downwardly directed arm 31*a* or to a horizontally extending arm 31*b*. The lever 28' is also pivotable around a fulcrum point 21 of the bearing block 39. The actuating means 30' may also be used for both types of actuation according to FIGS. 3 and 4.

Figure 5:
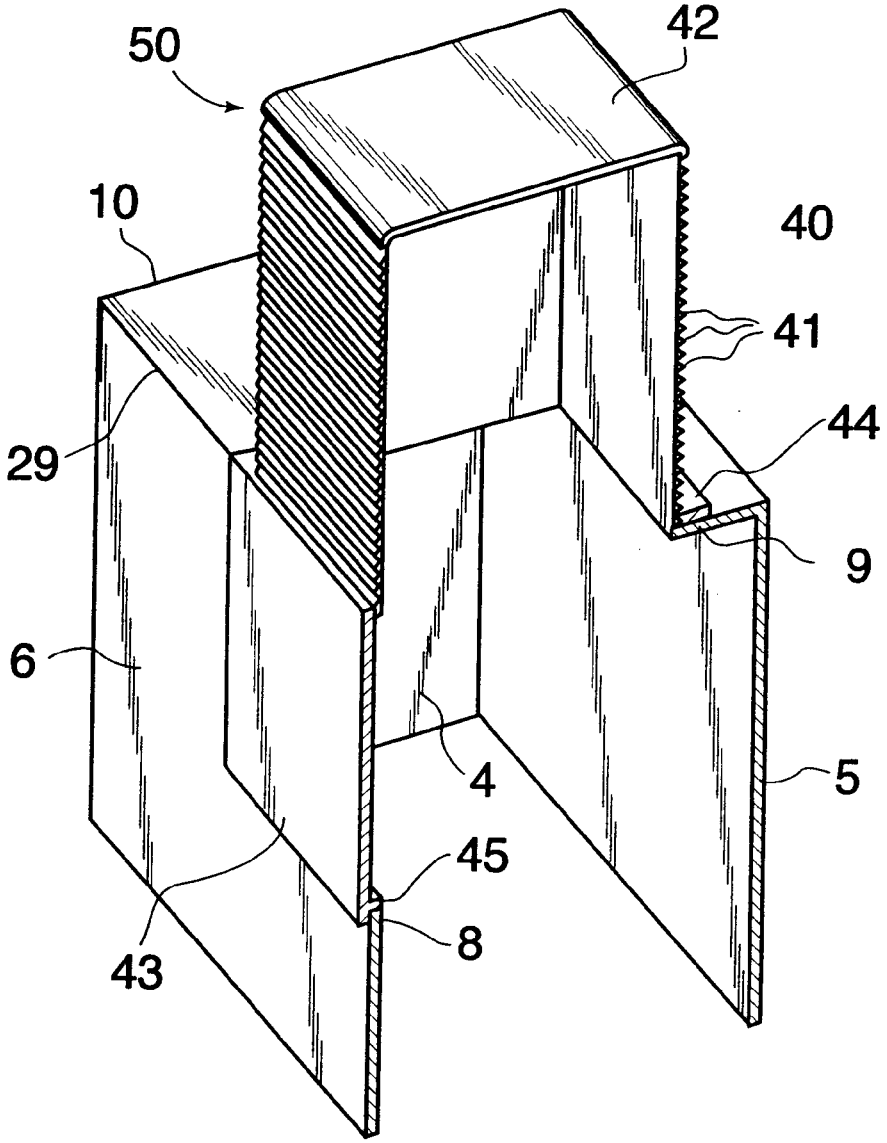
Figure 6:
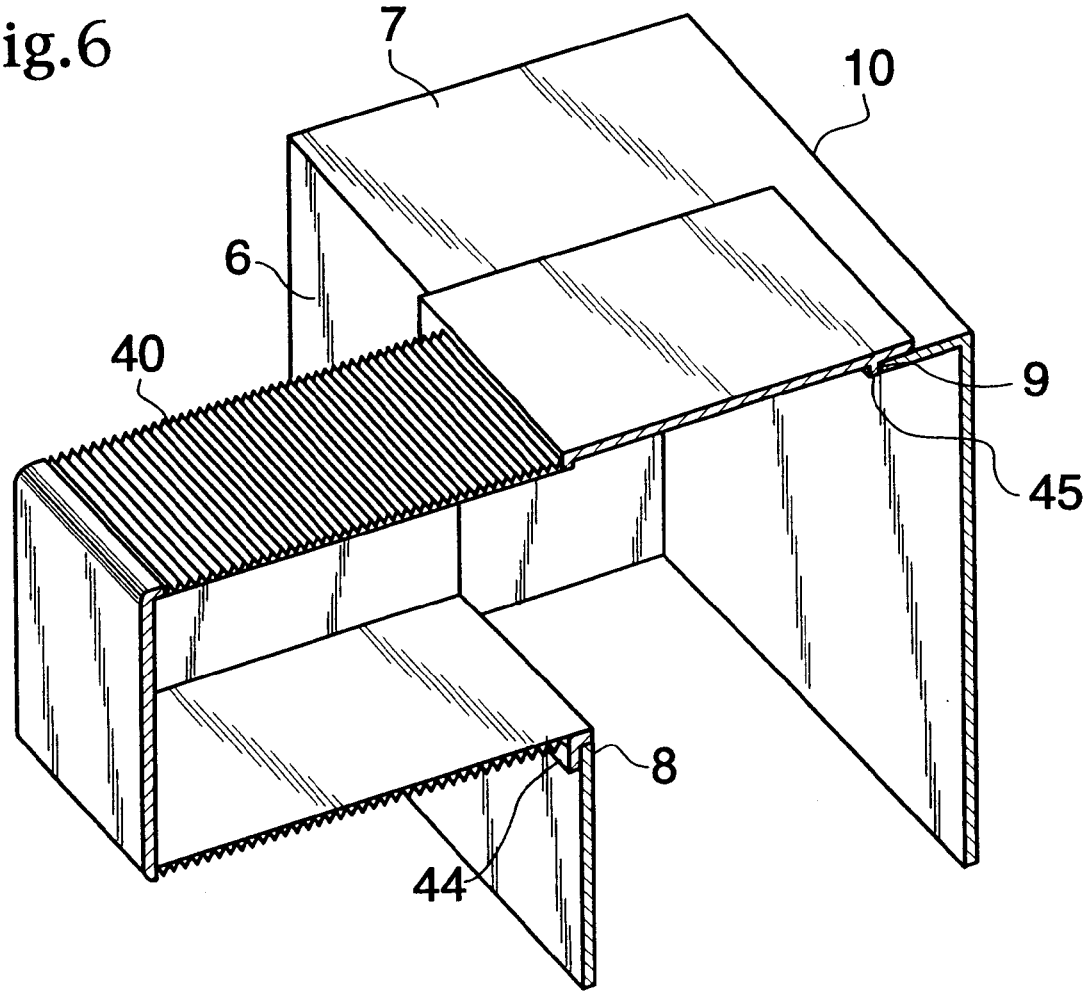
FIG. 6 shows a section according to FIG. 5, but with actuation from the front.

The embodiment variant of the flush-mounted flush tank 1 shown in FIGS. 5 and 6 differs by the building protection frame 40 shown here, which forms one unit with a closing plate 43. The inspection openings 8 and 9 of the tank body 10 are connected to one another via the edge 29. For actuation from the top, the building protection frame 40 is placed on the tank body 10 such that the inspection opening 8 is closed by the closing plate 43. The inspection opening 9 is covered, in contrast, by the building protection frame 40. This has in this case a cover 42 made in one piece with it, but this cover may also be replaced with a cover placed on detachably. Edges 44 and 45 made in one piece connect the building protection frame 40 as well as the closing plate 43 to the tank body 10. These edges 44 and 45 may have locking means, not shown here, or other connection means. The cover 42 and optionally the strips 41 are broken off after the wall has been built. The inspection openings 8 and 9 are preferably congruent in this case as well.

The building protection frame 40 and the closing cover 43 preferably form a unit made of a suitable plastic, which is manufactured in one piece according to the injection molding technique. The design shown in FIGS. 5 and 6 is characterized by an especially small number of individual parts. This simplifies the manufacture and the stock keeping as well as the mounting. Mounting is especially simple if the unit 50 can be placed on, e.g., snapped onto, the tank body 10 without tools. The unit 50 may be placed on the tank body

10 in the corresponding orientation according to FIG. 5 or FIG. 6 already in the factory. The inspection openings 8 and 9 are closed by the unit 50 and the fittings 14 and 18 arranged in the tank body 10 are thus protected during transportation.

While specific embodiments of the invention have been shown and described in detail to illustrate the application of the principles of the invention, it will be understood that the invention may be embodied otherwise without departing from such principles.

What is claimed is:

1. A concealed flush tank comprising:

a tank body having walls including a bottom wall, a front wall, a rear wall, a first end wall, a second end wall and a top wall forming a single piece integral enclosure and defining a first inspection opening of a size to allow the insertion of flush fittings into the enclosure and to allow for the removal of flush fittings from the enclosure, said first inspection opening being defined in one of said walls, and defining a second inspection opening of a size to allow the insertion of flush fittings into the enclosure and to allow for the removal of flush fittings from the enclosure, said second inspection opening being defined in another of said walls; and a building protection frame connected to said tank body to cover one of said first inspection opening and said second inspection opening, further comprising:

a closing plate connected to said tank body for closing the other of said first inspection opening and said second inspection opening, said closing plate being connected to said building protection frame along a common edge, in a mounted state.

2. The concealed flush tank according to claim 1, wherein said closing plate engages said building protection frame in a positive-locking manner.

3. A concealed flush tank comprising:

a tank body having walls including a bottom wall, a front wall, a rear wall, a first end wall, a second end wall and a top wall forming a single piece integral enclosure and defining a first inspection opening of a size to allow the insertion of flush fittings into the enclosure and to allow for the removal of flush fittings from the enclosure, said first inspection opening being defined in one of said walls, and defining a second inspection opening of a size to allow the insertion of flush fittings into the enclosure and to allow for the removal of flush fittings from the enclosure, said second inspection opening being defined in another of said walls; and a building protection frame connected to said tank body to cover one of said first inspection opening and said second inspection opening, wherein said building protection frame includes a first end connectable to a detachable cover and a second end connectable to another detachable cover, said detachable cover and said another detachable cover being substantially identical.

4. The concealed flush tank according to claim 3, wherein one of said identical covers is a closing plate, closing said one of said first inspection opening and said second inspection opening.

5. A concealed flush tank assembly, comprising:

a tank body having walls including a bottom wall, a front wall, a rear wall, a first end wall, a second end wall and a top wall forming a single piece integral enclosure and defining a first inspection opening of a size to allow the insertion of flush fittings into the enclosure and to allow for the removal of flush fittings from the enclosure, said first inspection opening being defined in one of said walls, and defining a second inspection opening of a size to allow the insertion of flush fittings into the enclosure and to allow for the removal of flush fittings from the enclosure, said second inspection opening being defined in another of said walls; and a building protection frame connected to said tank body to cover one of said first inspection opening and said second inspection opening;

a bearing block disposed within said tank body;

a flush fitting actuator connected to said bearing block; and a push bar, said push bar being connected to said actuator and extending out of one of said first inspection opening and said second inspection opening.

6. The concealed flush tank according to said claim 5, wherein said flush fitting actuator has a first push bar fastener and a second push bar fastener; one of said first push bar fastener and said second push bar fastener being disposed for said push bar extending substantially horizontally and the other said first push bar fastener and said second push bar fastener being disposed for said push bar extending substantially vertically.

7. A concealed flush tank according to claim 5, further comprising a closing plate connected to said tank body and covering the other of said first inspection opening and said second inspection opening.

* * * * *